US005232227A

United States Patent [19]

Bateman

[11] Patent Number: 5,232,227

[45] Date of Patent: Aug. 3, 1993

[54] AUTOMATED STEEL KNOCK-DOWN TARGET SYSTEM

[76] Inventor: Kyle E. Bateman, P.O. Box 636, Provo, Utah 84603-0636

[21] Appl. No.: 843,427

[22] Filed: Feb. 28, 1992

[51] Int. Cl.[5] ..... F41J 1/00

[52] U.S. Cl. ..... 273/392; 273/406

[58] Field of Search ..... 273/392, 406, 407

[56] References Cited

U.S. PATENT DOCUMENTS 3,392,980 7/1968 Ortega ..... 273/406
4,614,345 9/1986 Doughty ..... 273/392 X
5,163,689 11/1992 Bateman ..... 273/406

*Primary Examiner*—William H. Grieb

[57] ABSTRACT

A target support structure and system which holds a steel plate target centered in a protective shroud. When the plate is hit, it falls over backwards, activating an internal position sensor. Then, when an internal reset mechanism is engaged, the plate is lifted back to the upright position. The system is easily mounted for permanent or portable use, may be activated through pneumatics or any adaptable power source, may be interfaced with electric, pneumatic, or similar control devices, may be used as a trigger device to activate other devices upon being hit, and is uniquely designed to minimize bullet splatter (fragments) and damage to surrounding fixtures, objects or people.

10 Claims, 3 Drawing Sheets

FIGURE 5
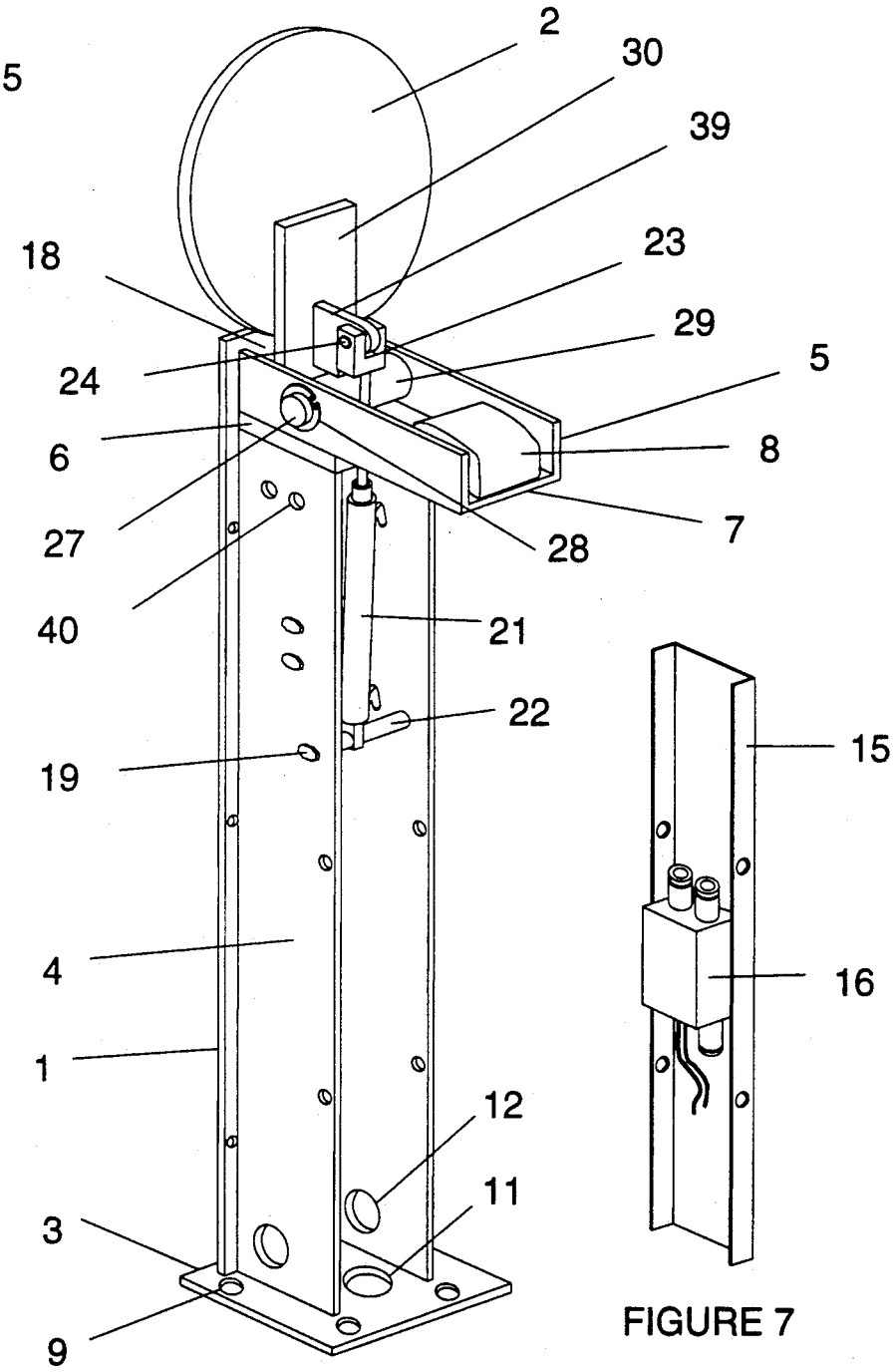
FIGURE 7
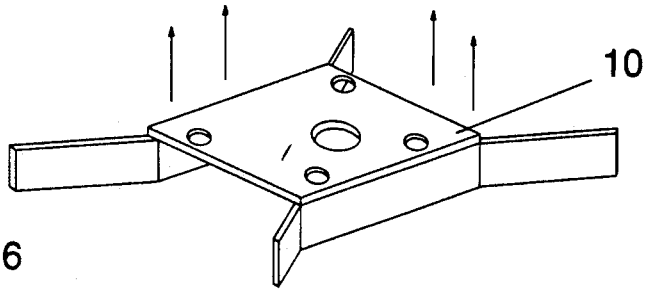
FIGURE 6

AUTOMATED STEEL KNOCK-DOWN TARGET SYSTEM

BACKGROUND

Other resettable steel plate systems that are commercially available suffer from one or more disadvantages which this present invention helps remedy. These disadvantages include being larger, heavier, less portable, relatively slow reacting, relatively complex, incapable of independent operation, inefficient, incapable of "chain-reaction" operation (where one target triggers a subsequent target), insufficiently armored to provide long-term service with minimal maintenance, or ineffective at containing bullet splatter in a consistent, predictable manner. The only known art incorporating some of the same advantages of this present invention are additional inventions by the same applicant for this invention. (See application Ser. No. 672,453—"Turning Target Support Structure and System," now U.S. Pat. No. 5,163,589, and "Versatile Popup/Knock-down Target System" (co-pending application Ser. No. 07/843,154). These other inventions incorporate some of the same armoring techniques and control devices, but each invention has unique characteristics which are not apparent modifications to one skilled in the art.

SUMMARY

It is an object of the present invention to provide an improved automated steel knock-down target system comprising:

(a) A base readily mounted to a flat solid surface or an optional wider mounting foot for free standing capability;

(b) A knock-down steel target assembly mounted to the top of and inside said base;

(c) A shroud mounted to the base and about the target system which protects adjacent fixtures without significantly increasing the risk to the shooter.

(d) A design for protecting the system support structure and minimizing bullet splatter, which design allows the attachment of a 2×6 board or similar facade to the front shield;

(e) A trap for catching downward splatter which otherwise could return toward the shooter.

(f) A design which provides protective barriers and a secondary stop surface for the falling target to prevent damage to the activator piston which activates the target.

(g) A sensor switch to detect the head plate being knocked down in response to a successful bullet hit.

(h) A mounting method for the sensor switch which detects the angle of the activator piston rather than using a direct mechanical interface with the head plate which could cause damage or premature failure of the switch mechanism due to the heavy forces exerted by the head plate as it falls to the horizontal position.

(i) A design which allows connection of the sensor switch directly into the activator piston such that the head plate will reset itself automatically each time it is knocked down.

(j) A design which allows connection of the sensor switch to external devices such as other targets such that they will be activated when the head plate is knocked down.

(k) An electric valve option such that the lifting and the knock down action of the head plate can be controlled remotely from a computer or some other type of electronic device.

BRIEF DESCRIPTION OF THE DRAWINGS

FIG. 5 shows a back angle of an embodiment of the automated steel knock-down target system without the shroud mounted in accordance with the present invention;

FIG. 6 shows an embodiment of an optional wider mounting foot for the automated steel knock-down target system in accordance with the present invention; and FIG. 7 shows an embodiment of an optional back cover plate with an optional electric valve for the automated steel knock-down target system in accordance with the present invention.

DESCRIPTION OF THE PREFERRED EMBODIMENT

Figure 2:
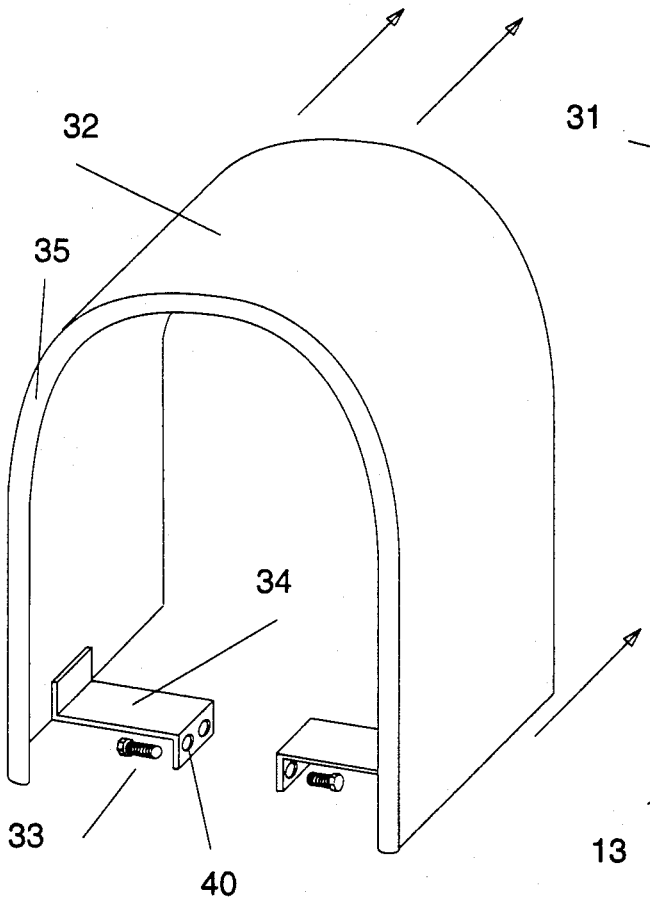
FIG. 2 shows a front angle of an embodiment of the shroud which is to be mounted to the automated steel knock-down target system in accordance with the present invention.
Figure 1:
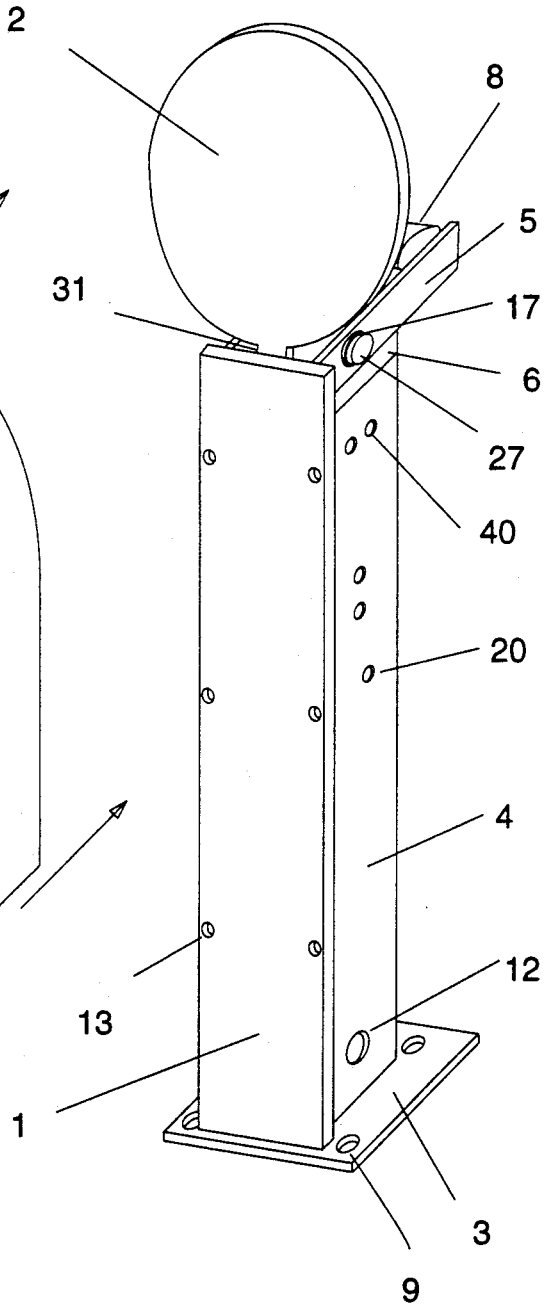
FIG. 1 shows a front angle of an embodiment of the automated steel knock-down target system without the shroud mounted in accordance with the present invention.

Referring to the accompanying drawings, there is illustrated a preferred embodiment of the Automated Steel Knock-down Target System according to the present invention. Most of the target system is preferably fabricated from hot rolled mild steel. The front shield (1) and head plate (2) are preferably fabricated from abrasion resistant steel plate.

The base is comprised of the mounting foot (3), the front shield (1), the side plates (4), the side rails (5), the anvil (6), and the bumper plate (7) which are welded together. Attached to the bumper plate (7) is the rubber bumper (8). There are holes (9) in the mounting foot (3) for the purpose of attaching the base to a solid surface such as concrete. Alternately, a wider mounting foot (10) can be attached using these same holes (9) to allow free standing capability for portable use.

There is a conduit bottom access hole (11) in the center area of the mounting foot (3) through which air supply and electrical signal lines can be run to operate the embodiment. Conduit side access holes (12) are also provided at the base of each side plate (4) for optional use. The front shield (1) has facade mounting holes (13) in it through which a variety of facades can be bolted. Welded to the top surface of the mounting foot (3) are the side plates (4) and the front shield (1). The side plates (4) are recessed slightly from the edges of the front shield (1) to allow the facade mounting holes (13) to be easily accessed from the outside of the chamber formed by the front shield (1) and the side plates (4). This chamber can be enclosed by an optional back cover plate (15) to protect internal components and also to allow for the mounting of the optional electric valve

(16) for circumstances where electric triggering is required.

The side rails (5) are attached to the top of the side plates (4). The large holes (17) in the side rails (5) are used to form the main pivot point for the head plate (2). The side rails (5) also extend back to support the bumper plate (7) to which the rubber bumper (8) is attached.

The front shield (1) extends above the tops of the side rails (5) and is also placed at an appropriate distance from the front surface of the head plate (2) so as to create a cavity (18) which is used to catch bullet splatter coming off the head plate (2) and prevent it from returning to the shooter.

The anvil (6) is attached at the point where the side rails (5) meet the side plates (4) and is used to establish a stop for the head plate (2) as it reaches it upright position.

A bolt (19) passes through two holes (20) in the side plates (4) to form a base pivot for the activator piston (21) which, in the embodiment illustrated, is a commercially available, double acting, pneumatic piston. Two spacers (22) are used to hold the activator piston (21) base in a position which is centered between the two side plates (4). The upper end of the activator piston (21) attaches to the tang (39) by means of the rod clevis (23) and the clevis pin (24).

Mounted to one side plate (4) between the activator piston (21) and the front shield (1) is the knock-down sensor switch (25). This switch is a commercially available, 4-way air valve which is activated by a push-button (26).

Two large holes (17) are located in the side rails (5) through which the pivot pin (27) passes. Fabricated from round steel rod, this pin has grooves machined in each end to allow attachment of retaining clips (28) which hold it in place. The pivot pin (27) acts as an axle around which the pivot tube (29) can turn. This tube is a section of round steel tubing onto which the head plate support (30) is welded. Also welded to the head plate support (30) is the tang (39).

The head plate (2) is welded to the head plate support (30). Welded to both the head plate support (30) and the bottom of the head plate (2) is the plate leg (31) which stabilizes the head plate (2) when it is in the vertical position. The plate leg (31) also acts as a stop device when it strikes the anvil (6).

The shroud (32) is attached to the base by means of bolts (33) passing through holes (40) in the mounting brackets (34) and in the side plates (4). The return splatter guard (35), which is preferably fabricated from round steel rod, is welded to the front edge of the shroud (32).

The operation of the preferred embodiment of this present invention is basically as follows: first, the mounting foot (3) is optionally attached to a solid surface. The front shield (1) is designed to have a facade attached to prevent bullet splatter and to provide additional protection to the embodiment. Specifically, the bullet passes through the soft facade and strikes the front shield (1). Upon impact, the bullet mushrooms against the steel surface and is safely captured in the facade rather than being allowed to splatter back toward the shooter. The facade, which in the preferred embodiment is constructed of wood, can advantageously be easily and economically replaced as needed.

Power is provided to the system by means of one or more air supply hoses (not shown) which enter through a conduit access hole (11) or (12). These hoses may connect directly to the activator piston (21) if desired. Or, switching of the air supply may be accomplished by the electric valve (16), the knock-down sensor switch (25), or other external devices which are not part of this present invention.

If the air flow is directed to extend the activator piston (21), the head plate (2) (which is the "target") will be lifted to the vertical position. Then, once the air pressure has been removed, the head plate (2) will be free to be knocked down by a bullet. As an option, the air flow may also be directed to retract the activator piston (21). This will cause the head plate (2) to fall down and out of view of the shooter.

Figure 4:
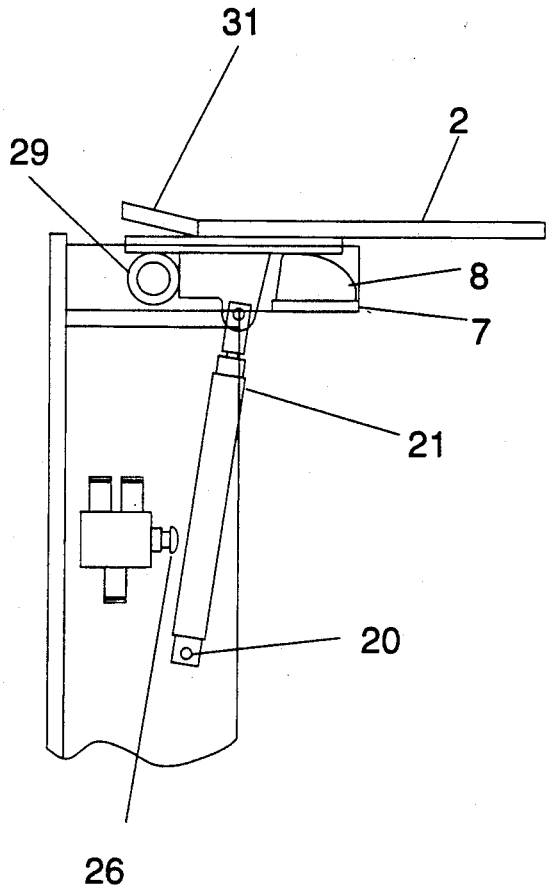
FIG. 4 shows a side angle exposing the inside of the top portion of an embodiment of the automated steel knock-down target system with the target plate horizontal in accordance with the present invention.

When the head plate (2) is struck by a bullet, it falls over backward (See FIG. 4.) This motion is cushioned by the rubber bumper (8) which is struck by the head plate support (30).

The side rails (5) form a protective barrier on each side of the rubber bumper (8) to help prevent it from being damaged by errant bullets. However, in the case where the rubber bumper (8) is damaged (or torn away completely) the side rails (5) provide a secondary stop surface to prevent the falling motion of the head plate (2) from damaging the activator piston.

Figure 3:
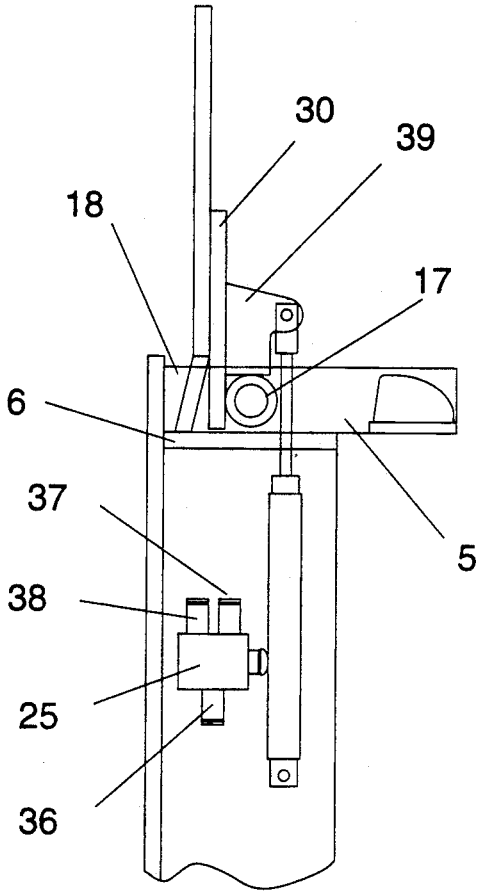
FIG. 3 shows a side angle exposing the inside of the top portion of an embodiment of the automated steel knock-down target system with the target plate vertical in accordance with the present invention.

The knock-down sensor switch (25) is used to switch an air flow based upon the position of the head plate (2). When the head plate (2) is in the horizontal position, the push-button (26) is not pressed so air flows in the supply input (36) and out the "normally on" output (37). (See FIG. 4.) When the head plate (2) is in the vertical position the activator piston (21) rocks forward and presses the push-button (26) so the air will flow out the "normally off" output (38). (See FIG. 3.) The knock-down sensor switch (25) may be used to reset the head plate (2) automatically or, to direct air flow for a variety of other uses including the operation of other targets in a "chain reaction" sequence.

When a bullet impacts the head plate (2), the bullet breaks up into small fragments which are referred to as "splatter." These fragments travel out from the point of impact in a conical pattern about 10 to 15 degrees from parallel with the surface of the plate. Normally, this splatter can be damaging to adjacent walls, lights or other fixtures. With the addition of the shroud (32), most splatter is caught other than that which is traveling down toward the ground. Splatter which might hit the shroud (32) and then, subsequently bounce toward the shooter, is caught by the return splatter guard (35). So, the shroud (32) provides protection for adjacent fixtures without significantly increasing risk to the shooter.

It is understood that the present invention is not limited to the preferred embodiment presented but is susceptible to a number of modifications as are apparent to one skilled in the art. I do not, therefore, wish to limit the present invention to the detail shown and described herein, but intend to cover all modifications which are obvious to one skilled in the art.

The embodiments of the invention in which an exclusive property or privilege is claimed are defined as follows:

1. An improved Automated Steel Knock-down Target System comprising:

(a) A base readily mounted to a flat solid surface or an optional wider mounting foot for free standing capability;

(b) A knock-down steel target assembly mounted to the top and inside of said base;

(c) A means for protecting the system support structure and minimizing bullet splatter, which allows the attachment of a 2×6 facade to the front shield;

(d) A trap for catching downward splatter which otherwise could return toward the shooter;

(e) A means which provides protective barriers and a secondary stop surface for the falling target to prevent damage to the activator piston which activates the target;

(f) A sensor switch to detect the head plate being knocked down in response to a successful bullet hit;

(g) A mounting means for the sensor switch which detects the angle of the activator piston rather than using a direct mechanical interface with the head plate which could cause damage or premature failure of the switch mechanism due to the heavy forces exerted by the head plate as it falls to the horizontal position;

(h) A means which allows connection of the sensor switch directly into the activator piston such that the head plate will reset itself automatically each time it is knocked down;

(i) A means which allows connection of the sensor switch to external devices such as other targets such that they will be activated when the head plate is knocked down;

(j) An electric valve option such that the lifting and the knock down action of the head plate can be controlled remotely from an electric control device.

2. A system according to claim 1 wherein the target movement is actuatable through pneumatics and is compatible for interface with either an electric or a pneumatic control device.

3. A system according to claim 1 wherein the target movement is actuatable through electricity and is compatible for interface with either an electric or a pneumatic control device.

4. A system according to claim 1 wherein the target movement is actuatable through any adaptable power source and is compatible for interface with any adaptable control device.

5. A system according to claim 1, further comprising; a shroud mounted to the base and about the target system which protects adjacent fixtures without significantly increasing the risk to the shooter.

6. A system according to claim 5 wherein the shroud is mounted to a separate support structure.

7. A system according to claim 5 wherein the shroud is constructed of metal.

8. A system according to claim 5 wherein the shroud is constructed of a non-metallic material.

9. A system according to claim 5 wherein the shroud is constructed in a curved shape about the target system.

10. A system according to claim 5 wherein the shroud is constructed in a angular shape about the target system.

* * * * *